US008327673B2

(12) United States Patent
Oak et al.

(10) Patent No.: US 8,327,673 B2
(45) Date of Patent: Dec. 11, 2012

(54) WASHING MACHINE WITH BUBBLE GENERATOR

(75) Inventors: Seong Min Oak, Masan-si (KR); Sang Yeon Pyo, Suwon-si (KR); Hyun Sook Kim, Suwon-si (KR); Jae Ryong Park, Hwaseong-si (KR); Dong Pil Seo, Daejeon (KR); Bo Ram Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 770 days.

(21) Appl. No.: 12/071,914

(22) Filed: Feb. 27, 2008

(65) Prior Publication Data

US 2008/0250823 A1 Oct. 16, 2008

(30) Foreign Application Priority Data

Apr. 11, 2007 (KR) ..... 10-2007-0035779

(51) Int. Cl.
*D06F 39/08* (2006.01)
*D06F 29/00* (2006.01)

(52) U.S. Cl. ..... 68/183; 68/207

(58) Field of Classification Search ..... 68/183, 68/207, 208

See application file for complete search history.

(56) References Cited

U.S. PATENT DOCUMENTS 5,253,380 A * 10/1993 Lim et al. ..... 8/158
5,295,373 A * 3/1994 Lim et al. ..... 68/12.05
5,307,649 A * 5/1994 Lim et al. ..... 68/12.05
5,590,551 A * 1/1997 Hong ..... 68/183
5,765,997 A * 6/1998 You ..... 417/312
5,771,719 A * 6/1998 Moon ..... 68/183
6,094,948 A * 8/2000 Hong et al. ..... 68/183
6,148,649 A * 11/2000 Shin ..... 68/183
6,170,303 B1 * 1/2001 Hong et al. ..... 68/183
6,868,701 B2 * 3/2005 Lee ..... 68/183
7,296,444 B2 * 11/2007 Mae et al. ..... 68/12.04
2004/0172985 A1 * 9/2004 Mamiya et al. ..... 68/12.05

FOREIGN PATENT DOCUMENTS

| | | |
|---|---|---|
| CN | 1178269 | 4/1998 |
| JP | 7-178279 | 7/1995 |
| JP | 2005-7224 | 1/2005 |
| KR | 10-2006-0127641 | 12/2006 |

OTHER PUBLICATIONS

Chinese Office Action for corresponding Chinese application 200810083375.3; issued Oct. 16, 2009.
Chinese Office Action for corresponding Chinese Patent Application No. 200810083375.3 dated Aug. 5, 2011.
Korean Office Action for corresponding Korean Patent Application No. 10-2007-0035779 dated Dec. 15, 2011.

* cited by examiner

*Primary Examiner* — Joseph L Perrin
(74) *Attorney, Agent, or Firm* — Staas & Halsey LLP

(57) ABSTRACT

Disclosed is a washing machine having a bubble generator to wash laundry using bubbles. The washing machine includes a tub to contain washing water; and a bubble generator generating bubbles and supplying the bubbles to the tub, the bubble generator including a bubble generation pump allowing the washing water to flow therethrough and an ejector unit formed at one side thereof to mix air with the washing water. The washing machine minimizes a reduction of the speed of the washing water due to a passage resistance, and thus increases an amount of generated bubbles.

16 Claims, 2 Drawing Sheets

WASHING MACHINE WITH BUBBLE GENERATOR

CROSS-REFERENCE TO RELATED APPLICATIONS

This application claims the benefit of Korean Patent Application No. 2007-0035779, filed Apr. 11, 2007, in the Korean Intellectual Property Office, the disclosure of which is incorporated herein by reference.

BACKGROUND

1. Field

The present invention relates to a washing machine, and more particularly, to a washing machine having a bubble generator to wash laundry using bubbles.

2. Description of the Related Art

Generally, washing machines, which respectively include a tub to contain washing water and a drum rotatably installed in the tub to contain laundry. Recently among these washing machines, there is a washing machine, which move the laundry along an inner surface of the drum upwardly due to a rotation of the to wash the laundry using a head of water.

Among these washing machines, a washing machine with a bubble generator has been proposed. The bubble generator generates bubbles serving as a cushion to reduce friction between laundry, and thus reduces damage to the laundry due to the friction between the laundry.

The bubble generator includes a bubble generation pump, which causes washing water contained in a tub to flow, and an ejector, which inhales air and mixes the air with the washing water supplied from the bubble generation pump to generate bubbles. The bubble generation pump and the ejector are connected through a connection pipe so that the washing water can be transmitted from the bubble generation pump to the ejector through the connection pipe.

In the above conventional washing machine, a speed of the washing water is inevitably reduced due to a passage resistance during a process for transmitting the washing water from the bubble generation pump to the ejector through the connection pipe, and thus the amount of air inhaled into the ejector is reduced and the amount of the generated bubbles is reduced.

SUMMARY

Therefore, one aspect of the embodiment is to provide a washing machine, which more effectively generates bubbles through a bubble generator.

Additional aspects and/or advantages will be set forth in part in the description which follows and, in part, will be apparent from the description, or may be learned by practice of the invention.

The foregoing and/or other aspects are achieved by providing a washing machine including a tub to contain washing water; and a bubble generator generating bubbles and supplying the bubbles to the tub, the bubble generator including a bubble generation pump allowing the washing water to flow therethrough and an ejector unit formed at one side thereof to mix air with the washing water.

The ejector unit may have a tubular shape, guide the washing water discharged from the bubble generation pump, and be provided with a nozzle having a reduced inner diameter formed therein.

An air guide pipe may be connected to the ejector unit such that the air guide pipe communicates with the nozzle to allow air to be supplied to the nozzle.

The bubble generation pump may include a bubble generation motor generating a rotary force, an impeller rotated by the bubble generation motor and causing the washing water to flow, and a pump housing accommodating the impeller; and the ejector unit is formed at one side of the pump housing.

The washing machine further includes a drain pump allowing the washing water to flow therethrough and forcibly discharging the washing water, a suction drain pipe provided with one end connected to the tub and the other end connected to the drain pump to guide the washing water in the tub to the drain pump, and a washing water guide pipe provided with one end connected to the suction drain pipe and the other end connected to the bubble generation pump to guide the washing water in the tub to the bubble generation pump, the drain pump, suction drain pipe and washing water guide pipe being disposed below the tub.

The bubble generator may further include a bubble guide pipe provided with one end connected to the ejector unit and the other end connected to the tub to guide bubbles generated from the bubble generation pump to the tub.

The foregoing and/or other aspects are achieved by providing a washing machine including a tub containing washing water; and a bubble generation pump allowing the washing water to flow therethrough, mixing the washing water with air, and then transmitting the washing water mixed with the air to the tub.

The bubble generation pump may include a bubble generation motor generating a rotary force, an impeller rotated by the bubble generation motor and causing the washing water to flow, and a pump housing accommodating the impeller; and the washing machine further comprises an ejector unit mixing air with the washing water and formed at one side of the pump housing.

The foregoing and/or other aspects are achieved by providing a washing machine, including: a tub to receive washing water to wash laundry; a rotary drum disposed within the tub; a motor rotating the rotary drum to wash the laundry; a bubble generation pump receiving the washing water from the tub and ejecting the washing water toward the tub; and an air guide pipe causing air to be supplied to the ejected washing water to generate bubbles.

The washing machine may further include a bubble guide pipe transmitting the generated bubbles to the tub.

The washing machine may further include a suction drain pipe and a drain pump, the suction drain pipe supplying the washing water to the bubble generation pump and supplying washing water to the drain pump to be discharged from the washing machine.

The washing machine may further include an ejector unit integrally connected at one end to the bubble generation pump such that washing water ejected by the bubble generation pump passes through and is ejected by the ejector unit.

The foregoing and/or other aspects are achieved by providing a washing machine includes a washing water guide pipe to guide washing water from a tub, and a bubble generator to generate bubbles in the washing water guided by the washing water guide pipe, wherein the bubble generator includes a bubble generation pump, through which the washing water guided by the washing water guide pipe passes, an ejector unit, into which the washing water discharged from the bubble generation pump flows, a nozzle, into which the washing water passed through the ejector unit flows, and an air guide pipe to guide air to the nozzle, and the washing water passed through the nozzle is supplied to the tub.

BRIEF DESCRIPTION OF THE DRAWINGS

These and/or other aspects and advantages will become apparent and more readily appreciated from the following description of the embodiment, taken in conjunction with the accompanying drawings in which.

DETAILED DESCRIPTION OF THE EMBODIMENT

Figure 1:
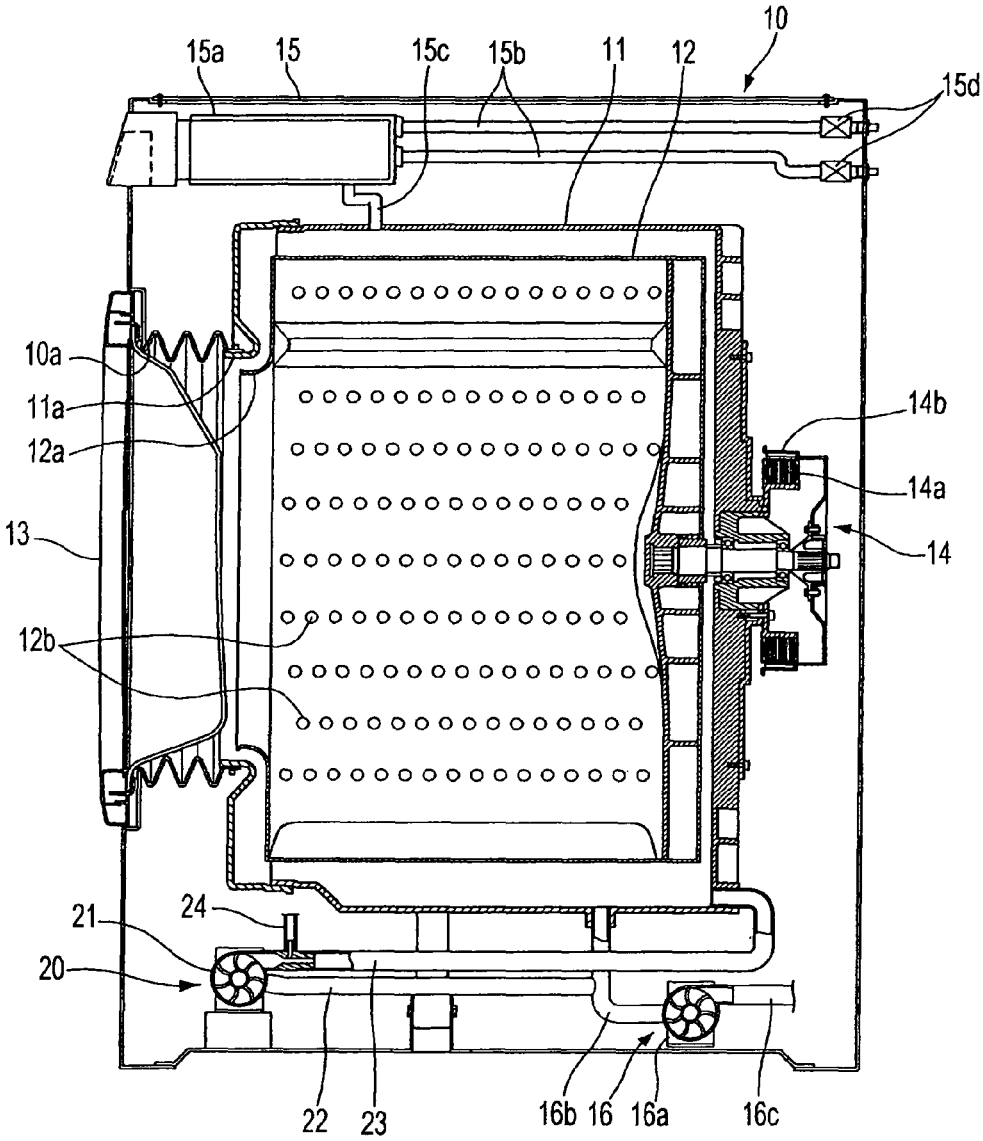
FIG. 1 is a schematic sectional view of a washing machine in accordance with the present embodiment.

Reference will now be made in detail to the embodiment, an example of which is illustrated in the accompanying drawings, wherein like reference numerals refer to like elements throughout. The embodiment is described below to explain the present invention by referring to the annexed drawings.

A washing machine in accordance with the present embodiment, as shown in FIG. 1, includes a tub 11 installed in a housing 10 forming an external appearance of the washing machine to contain washing water, and a drum 12 rotatably installed in the tub 11.

An inlet 10*a*, through which the laundry is put into the drum 12, is formed through a front surface of the housing 10, and openings 11*a* and 12*a*, through which the laundry is put into the drum 12, are respectively formed through the front surfaces of the tub 11 and the drum 12 to correspond to the inlet 10*a* of the housing 10. Further, a door 13 to open and close the inlet 10*a* is hinged to one side of the inlet 10*a* of the housing 10.

A driving motor 14 to rotate the drum 12 is installed at the outside of the rear surface of the tub 11. The driving motor 14 includes a stator 14*a* fixed to a rear surface of the tub 11, a rotor 14*b* rotatably disposed at the outside of the stator 14*a*, and a rotary shaft 14*c* provided with one end fixed to the rotor 14*b* and the other end passing through the tub 11 and fixed to the rear surface of the drum 12.

The front end of the rotary shaft 14*c* is fixed to the central portion of the rear surface of the drum 12, and through holes 12*b* to pass washing water are formed through the circumferential surface of the drum 12.

A water and detergent supply device 15 to supply washing water and a detergent to the insides of the tub 11 and the drum 12 is installed above the tub 11 in an upper portion of the housing 10, and a drain device 16 to forcibly discharge the washing water contained in the tub 11 to the outside is provided below the tub 11.

The water and detergent supply device 15 includes a detergent case 15*a* to contain the detergent and mix the supplied washing water with the detergent, supply pipes 15*b* respectively provided with ends connected to an external water supply source and the other ends connected to the detergent case 15*a* to supply water to be used to wash the laundry to the detergent case 15*a*, a water supply pipe 15*c* provided with one end connected to the detergent case 15*a* and the other end connected to the tub 11 to allow the detergent and the washing water to be supplied to the tub 11, and water supply valves 15*d* respectively disposed in the supply pipes 15*b* to open and close the supply pipes 15*b*. The drain device 16 includes a drain pump 16*a* to make the washing water flow and forcibly discharge the washing water, a suction drain pipe 16*b* provided with one end connected to the tub 11 and the other end connected to the drain pump 16*a* to guide the washing water contained in the tub 11 to the drain pump 16*a*, and a discharge drain pipe 16*c* provided with one end connected to the drain pump 16*a* and the other end passing through the housing 10 and extended to the outside to discharge the washing water discharged from the drain pump 16*a* to the outside of the housing 10.

Figure 2:
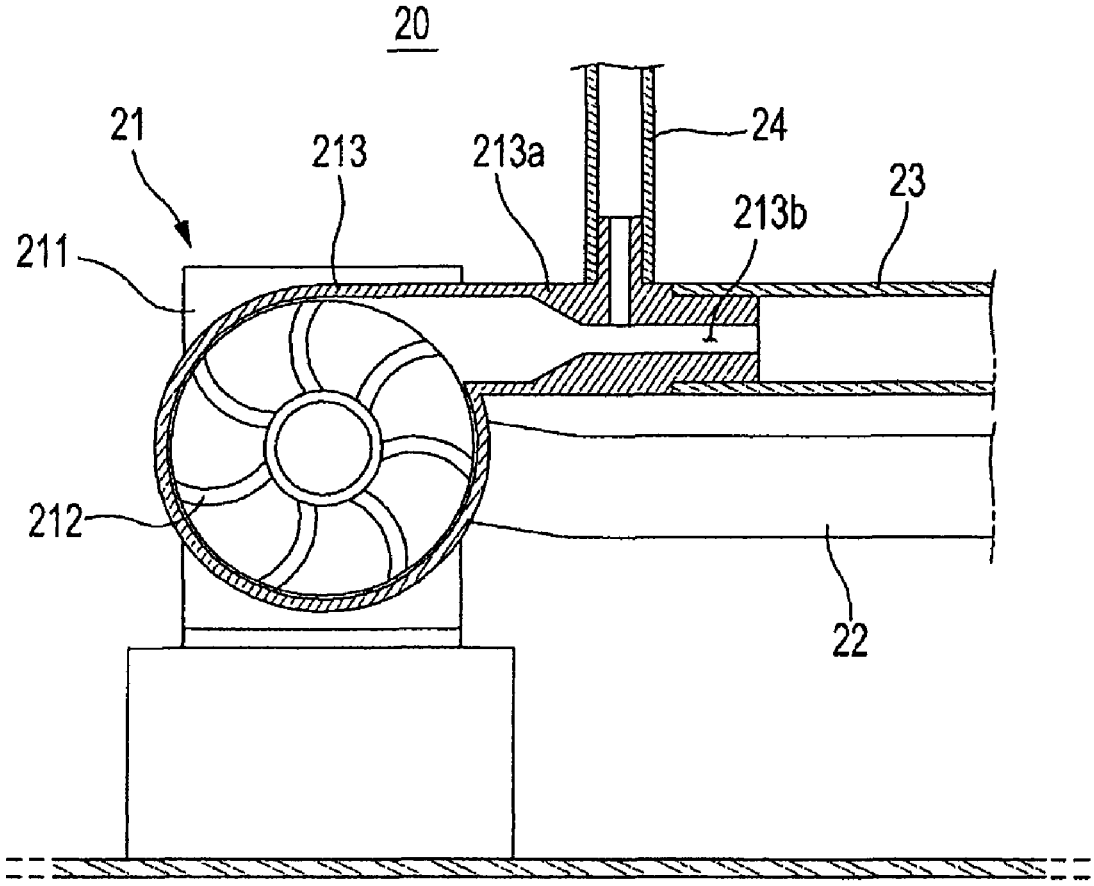
FIG. 2 is a sectional view of a bubble generator applied to the washing machine in accordance with the present embodiment.

The washing machine in accordance with the present embodiment further includes a bubble generator 20 to generate bubbles and supply the bubbles to the tub 11 to wash laundry using the bubbles. The bubble generator 20, as shown in FIG. 2, includes a bubble generation pump 21 to make the washing water flow and mix air with the washing water, a washing water guide pipe 22 provided with one end connected to the suction drain pipe 16*b* and the other end connected to the bubble generation pump 21 to cause the washing water from the tub 11 to be inhaled into the bubble generation pump 21 through the suction drain pipe 16*b*, a bubble guide pipe 23 provided with one end connected to the bubble generation pump 21 and the other end connected to the tub 11 to guide bubbles generated from the bubble generation pump 21 to the tub 11, and an air guide pipe 24 installed on the bubble generation pump 21 to guide the air to be mixed with the washing water to the bubble generation pump 21. Thus, while the washing water is transmitted from the tub 11 to the bubble generation pump 21 through the suction drain pipe 16*b* and the washing water guide pipe 22 and passes through the bubble generation pump 21, the washing water is mixed with the air transmitted through the air guide pipe 24, thus generating bubbles. Then, the bubbles are transmitted to the tub 11 through the bubble guide pipe 23, and the bubbles transmitted to the tub 11 flow into the drum 12 via the through holes 12 and thus reduce friction between laundries contained in the drum 12.

The bubble generation pump 21, applied to the washing machine in accordance with the present embodiment, is provided with an ejector unit 213*a* formed at one side thereof to inhale air and mix the air with the washing water. The ejector unit 213*a* has a tubular shape and is provided with a nozzle 213*b* having a reduced inner diameter formed therein. When the ejector unit 213*a* is formed at one side of the bubble generation pump 21, as described above, it is possible to minimize a reduction of the speed of the washing water due to a passage resistance and thus bubbles are effectively generated. In this embodiment, the ejector unit 213*a* is extended integrally from one side of the bubble generation pump 21.

In this embodiment, the bubble generation pump 21 includes a bubble generation motor 211 generating a rotary force, an impeller 212 rotated by the bubble generation motor 211 and making the washing water flow, and a pump housing 213 accommodating the impeller 212. The ejector unit 213*a* is formed at one side of the pump housing 213, and the air guide pipe 24 is connected to the ejector unit 213*a* such that the air guide pipe 24 communicates with the nozzle 213*b*. The impeller 212 is a centrifugal impeller, which inhales the washing water in an axial direction and discharges the washing water outwardly in a radial direction. The washing water guide pipe 22 is connected to the pump housing 213 in the axial direction of the impeller 22, and the bubble guide pipe 23 is connected to the front end of the ejector unit 213*a*.

Accordingly, when the bubble generator 20 is operated, the impeller 22 is rotated, and thus the washing water is discharged to the bubble guide pipe 23 through the ejector unit 213*a*. While the washing water, which is discharged to the bubble guide pipe 23 through the ejector unit 213*a*, passes through the nozzle 213*b*, the speed of the washing water is rapidly raised, but the pressure of the washing water passing through the nozzle 213*b* becomes lower than the atmospheric pressure in inverse proportion to the speed of the washing water. Thus, air is inhaled to the nozzle 213*b* through the air guide pipe 24 communicated with the nozzle 213*b*. While the washing water passes through the nozzle 213*b*, the washing water is mixed with the air transmitted from the air guide pipe 24, thus generating bubbles. Here, the amount of the air inhaled through the air guide pipe 24 is in direct proportion to the speed of the washing water passing through the nozzle 213*b*. That is, the higher the speed of the washing water, the more the amount of the generated bubbles increases. Accordingly, in the case that the ejector unit 213*a* is formed at one side of the pump housing 213 to minimize the reduction of the speed of the washing water due to the passage resistance, the amount of the bubbles generated from the bubble generator 20 is increased.

As apparent from the above description, the present embodiment provides a washing machine, in which an ejector unit to mix air with washing water is formed at one side of a bubble generation pump, thereby minimizing the reduction of the speed of the washing water due to a passage resistance and thus increasing the amount of generated bubbles.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A washing machine, comprising:

a tub to contain washing water;

a pump to cause the washing water to be drawn from the tub and pumped back into the tub;

an ejector unit coupled between the pump and the tub to mix air with the washing water being pumped back into the tub via the pump, the ejector unit including a water passageway defined by at least a first section and a second section which an effective inner diameter of the second section of the water passageway is smaller than an effective inner diameter of the first section, and an air inlet in communication with the water passageway, wherein the washing water rapidly passing through the water passageway of the ejector unit causes air to be inhaled via the air inlet and mixed with the washing water, forming air bubbles in the washing water exiting the ejector unit; and an air guide pipe coupled to the air inlet of the ejector unit to allow air to be supplied to the ejector unit, wherein the washing water with air bubbles from the ejector unit is supplied to the tub, and the air inlet of the ejector unit is in direct communication with the second section of the water passageway to directly allow air to be supplied to the second section of the water passageway.

2. The washing machine according to claim 1, wherein the ejector unit is provided with a nozzle which has a reduced inner diameter formed therein.

3. The washing machine according to claim 1, wherein:

the pump includes a motor generating a rotary force, an impeller rotated by the motor and causing the washing water to flow, and a pump housing accommodating the impeller; and the ejector unit is formed at one side of the pump housing.

4. The washing machine according to claim 1, further comprising a drain pump allowing the washing water to flow therethrough and forcibly discharging the washing water, a suction drain pipe provided with one end connected to the tub and the other end connected to the drain pump to guide the washing water in the tub to the drain pump, and a washing water guide pipe provided with one end connected to the suction drain pipe and the other end connected to the bubble generation pump to guide the washing water in the tub to the pump, the drain pump, suction drain pipe and washing water guide pipe being disposed below the tub.

5. The washing machine according to claim 1, further comprising a bubble guide pipe provided with one end connected to the ejector unit and the other end connected to the tub to guide bubbles generated from the bubble generation pump to the tub.

6. A washing machine, comprising:

a tub to contain washing water;

a bubble generation pump allowing the washing water to flow therethrough, mixing the washing water with air, and transmitting the washing water mixed with the air to the tub; and an ejector unit mixing air with the washing water and formed at one side of the pump housing, wherein the ejector unit has a tubular shape, guides the washing water discharged from the bubble generation pump, and is provided with a nozzle having a reduced inner diameter formed therein and an air guide pipe is connected to the ejector unit such that the air guide pipe is communicated with the nozzle, where the reduced inner diameter is formed, directly to allow air to be supplied to the nozzle.

7. The washing machine according to claim 6, wherein:

the bubble generation pump includes a bubble generation motor generating a rotary force, an impeller rotated by the bubble generation motor and causing the washing water to flow, and a pump housing accommodating the impeller.

8. A washing machine, comprising:

a tub to receive washing water to wash laundry;

a rotary drum disposed within the tub;

a motor rotating the rotary drum to wash the laundry;

a bubble generation pump receiving the washing water from the tub and ejecting the washing water toward the tub;

an ejector unit connected at one end to the bubble generation pump such that washing water ejected by the bubble generation pump passes through and is ejected by the ejector unit; and an air guide pipe causing air to be supplied to the ejected washing water to generate bubbles, wherein the ejector unit has a tubular shape, guides the washing water discharged from the bubble generation pump, and is provided with a nozzle which has a reduced inner diameter formed therein, and the air guide pipe is connected to the ejector unit such that the air guide pipe is communicated with the nozzle, where the reduced inner diameter is formed, directly to allow air to be supplied to the nozzle.

9. The washing machine according to claim 8, further comprising a bubble guide pipe transmitting the generated bubbles to the tub.

10. The washing machine according to claim 8, further comprising a suction drain pipe and a drain pump, the suction drain pipe supplying the washing water to the bubble generation pump and supplying washing water to the drain pump to be discharged from the washing machine.

11. A washing machine comprising:

a washing water guide pipe to guide washing water from a tub; and a bubble generator to generate bubbles in the washing water guided by the washing water guide pipe, wherein:

the bubble generator includes a bubble generation pump, through which the washing water guided by the washing water guide pipe passes, an ejector unit, into which the washing water discharged from the bubble generation pump flows, a nozzle, into which the washing water passed through the ejector unit flows and has a reduced inner diameter formed therein, and an air guide pipe, which is connected directly to the nozzle, where the reduced inner diameter is formed, to guide air to the nozzle; and the washing water passed through the nozzle is supplied to the tub.

12. The washing machine according to claim 11, further comprising a bubble guide pipe to guide the bubbles to the tub.

13. The washing machine according to claim 11, further comprising a drum disposed within the tub, wherein:

through holes to pass the washing water are formed through the drum; and the bubbles flow into the drum via the through holes.

14. The washing machine according to claim 13, further comprising a drain pump formed separately from the bubble generation pump to drain the washing water in the tub.

15. The washing machine according to claim 11, wherein the ejector unit is formed at one side of the bubble generation pump.

16. A washing machine, comprising:

a tub to contain washing water;

a drum rotatably installed in the tub, and a bubble generator generating bubbles, wherein the bubble generator includes a bubble generation pump allowing the washing water to flow therethrough from the tub, an ejector unit formed at one side thereof and is provided with a nozzle which has a reduced inner diameter formed therein, an air inlet provided in the upper portion of the nozzle, to receive and mix air with the washing water, and a bubble guide pipe between the nozzle and the tub to supply the bubbles between the tub and the drum, wherein the ejector unit has a tubular shape, and guides the washing water discharged from the bubble generation pump and wherein an air guide pipe is connected to the ejector unit such that the air guide pipe is communicated with the nozzle, where the reduced inner diameter is formed, directly to allow air to be supplied to the nozzle.

* * * * *

UNITED STATES PATENT AND TRADEMARK OFFICE

CERTIFICATE OF CORRECTION

PATENT NO. : 8,327,673 B2
APPLICATION NO. : 12/071914
DATED : December 11, 2012
INVENTOR(S) : Seong Min Oak et al.

It is certified that error appears in the above-identified patent and that said Letters Patent is hereby corrected as shown below:

In the Claims

Column 5; Line 35; In Claim 1, before "which" insert -- in --.

Signed and Sealed this
Fourteenth Day of May, 2013

Teresa Stanek Rea
*Acting Director of the United States Patent and Trademark Office*